US006453986B1

(12) United States Patent
Leabeater et al.

(10) Patent No.: US 6,453,986 B1
(45) Date of Patent: Sep. 24, 2002

(54) METAL DELIVERY SYSTEM FOR CONTINUOUS CASTER

(75) Inventors: Stephen Bruce Leabeater, Albion Park (AU); Andrew Arthur Shook, Oro Valley, AZ (US)

(73) Assignees: Ishikawajima-Harima Heavy Industries Company Limited, Tokyo (JP); BHP Steel (JLA) Pty Ltd., Melbourne (AU)

( * ) Notice: Subject to any disclaimer, the term of this patent is extended or adjusted under 35 U.S.C. 154(b) by 0 days.

(21) Appl. No.: 09/564,457

(22) Filed: May 3, 2000

Related U.S. Application Data

(62) Division of application No. 09/101,781, filed as application No. PCT/AU97/00022 on Jan. 16, 1997, now Pat. No. 6,095,233.

(30) Foreign Application Priority Data

Jan. 24, 1996 (AU) ..... PN 7702

(51) Int. Cl.[7] ..... B22D 11/06
(52) U.S. Cl. ..... 164/483; 164/480; 164/488
(58) Field of Search ..... 164/480, 428, 164/483, 437, 488; 222/606, 607

(56) References Cited

U.S. PATENT DOCUMENTS 5,277,243 A * 1/1994 Fukase et al. ..... 164/428

FOREIGN PATENT DOCUMENTS

JP 2-200355 * 8/1990 ..... 164/428

* cited by examiner

*Primary Examiner*—M. Alexander Elve
*Assistant Examiner*—Len Tran
(74) *Attorney, Agent, or Firm*—Miles & Stockbridge P.C.; John C. Kerins

(57) ABSTRACT

A method and apparatus for continuously casting metal strip are provided, in which molten metal is introduced between a pair of parallel chilled casting rolls via an elongate metal delivery nozzle disposed above and extending along the nip between the casting rolls to form a casting pool supported on the rolls and the rolls are contra-rotated to produce the solidified strip. The molten metal is then delivered into a trough of the nozzle through an entry nozzle having an upper inlet end for receiving molten metal from a tundish, and a lower outlet end extending into the trough of the delivery nozzle, and the outlet end of the entry nozzle has a bottom wall, elongated side walls spaced inwardly from the side walls of the delivery nozzle and outlets for molten metal in the side walls.

17 Claims, 9 Drawing Sheets

METAL DELIVERY SYSTEM FOR CONTINUOUS CASTER

This application is a Div of 09/201,781 filed Oct. 19, 1996 now U.S. Pat. No. 6,095,233, which is a 371 of PCT/AU97/00022, filed Jan. 16, 1997.

BACKGROUND OF THE INVENTION

1. Field of the Invention

This invention relates to the casting of metal strip. It has particular but not exclusive application to the casting of ferrous metal strip.

2. Description of Related Art

It is known to cast metal strip by continuous casting in a twin roll caster. Molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle or a tundish into a smaller vessel from which it flows through a metal delivery nozzle located above the nip so as to direct it into the nip between the rolls, so forming a casting pool of molten metal supported on the casting surfaces of the rolls immediately above the nip. This casting pool may be confined between side plates or dams held in sliding engagement with the ends of the rolls.

Although twin roll casting has been applied with some success to non-ferrous metals which solidify rapidly on cooling, there have been problems in applying the technique to the casting of ferrous metals which have high solidification temperatures and tend to produce defects caused by uneven solidification at the chilled casting surfaces of the rolls. Much attention has therefore been given to the design of metal delivery nozzles aimed at producing a smooth even flow of metal to and within the casting pool.

It has previously been proposed to introduce the molten metal into the casting pool by means of a metal delivery nozzle projecting downwardly into and formed as an elongate trough with openings in its longitudinal side walls. In use, molten metal flows into the trough and thereafter into the molten metal pool via the openings in the longitudinal side walls in two mutually oppositely directed series of jet streams which are directed outwardly to impinge on the casting rolls. One example of a metal delivery nozzle of this kind is disclosed in the applicants' Australian Patent Application 60773/96.

The applicants have found metal delivery nozzles to be a particularly effective means of controlling the flow of molten metal into the molten metal pool.

In a commercial casting operation, molten metal will be delivered to a casting station in ladles and supplied to a twin roll caster either directly via the ladles or indirectly via a tundish. In practice, due to physical constraints it is probable that there will be a minimum gap of the order of 1 m between the outlet nozzle of a ladle or tundish and a metal delivery nozzle in the twin roll caster, with the consequence that molten metal will flow under high pressure from the ladle or the ladle/tundish assembly into the metal delivery nozzle unless an intermediate flow distributor is used such as that detailed in the applicants' Australian Patent Application 59352/94. Such devices, although successful, create additional cost, particularly through the requirement that they be refurbished after each use.

The term "tundish" as used herein, except in relation to the description of the preferred embodiment, is understood to mean any vessel which holds and feeds molten metal to a twin roll caster and includes, but is not limited to, vessels that are known by the terms "ladle" and "tundish". In the description of the preferred embodiment the term "tundish" is used in its normal context.

In view of the relatively small size of the metal delivery nozzle, the entry of molten metal at high pressure is likely to cause substantial undesirable splashing of molten metal from the metal delivery nozzle and damage to the metal delivery nozzle—particularly in the areas where the molten metal impinges directly on the metal delivery nozzle.

Japanese Patent Publication 1-5650 of Nippon Steel Corporation discloses a submerged entry nozzle as an alternative for supplying molten metal to a metal delivery nozzle of a twin roll caster. The metal delivery nozzle has outlets that supply molten metal into a casting pool in mutually oppositely directed streams towards the casting rolls. The submerged entry nozzle is of conventional configuration and is positioned so that the outlets direct molten metal into the metal delivery nozzle in streams that are parallel to the longitudinal axis of the rolls.

The applicants have carried out a water modelling programme with a conventional submerged entry nozzle positioned as described in Japanese Patent Publication 1-5650, ie with the outlets arranged to direct water flow parallel to casting rolls. In the programme, the submerged entry nozzle was positioned in a metal delivery nozzle of the type described in Australian Application 60773/96. The applicants were not able to develop satisfactory flow patterns within the delivery nozzle to supply water to the openings in the longitudinal side walls of the metal delivery nozzle. In addition, the applicants have found that the arrangement of the submerged entry nozzle and the metal delivery nozzle produced substantial splashing—which is undesirable.

An object of the present invention is to alleviate the disadvantages described in the preceding paragraph.

SUMMARY OF THE INVENTION

According to the present invention there is provided a twin roll caster for casting molten metal, the twin roll caster comprising;

(a) a pair of parallel casting rolls forming a nip between them;

(b) an elongate metal delivery nozzle disposed above and extending along the nip between the casting rolls for supplying molten metal to a casting pool of molten metal between the rolls, the metal delivery nozzle having a bottom wall, longitudinal side walls which extend parallel to the axes of the rolls, end walls, and outlets for molten metal in the side walls;

(c) an entry nozzle for supplying molten metal to the metal delivery nozzle, the entry nozzle having an inlet end for receiving molten metal and an outlet end for supplying molten metal into the metal delivery nozzle, the outlet end extending into the metal delivery nozzle and having a bottom wall, elongate side walls spaced inwardly of the side walls of the metal delivery nozzle, and end walls, and outlets for molten metal in the side walls; and (d) a tundish for supplying molten metal to the entry nozzle at the inlet end.

According to the present invention there is also provided a method of casting metal strip comprising, introducing molten metal between a pair of parallel chilled casting rolls via an entry nozzle of the type described in the preceding paragraph extending into an elongate metal delivery nozzle disposed above and extending along the nip between the rolls to form a casting pool of molten metal supported above the nip, and rotating the rolls to cast a solidified strip downwardly from the nip.

The outlets for molten metal in the entry nozzle may be in any suitable form, such as holes and slots.

The number and size of the outlets in the entry nozzle may be selected as required to suit particular casting requirements.

The main objective of the outlets in the entry nozzle is to enable the creation of optimum flow patterns of molten metal in the metal delivery nozzle. The optimum flow patterns in any given casting operation will depend on a range of factors including but not limited to the composition of the molten metal being cast.

It is preferred that the side walls of the entry nozzle be parallel to the side walls of the metal delivery nozzle.

It is also preferred that the outlets for molten metal in the entry nozzle are not laterally aligned with outlets of the delivery nozzle so that molten metal cannot flow directly from one outlet to the other.

The entry nozzle may comprise outlets for molten metal in its end walls.

The delivery nozzle may also comprise outlets for molten metal in its end walls.

It is preferred that the twin roll caster further comprises a ladle for supplying molten metal to the tundish It is preferred that the twin roll caster further comprises a control means, such as a sliding gate valve or a stopper rod, for controlling the flow rate of molten metal from the tundish into the entry nozzle.

It is also preferred that the metal delivery nozzle be an upwardly opening elongate trough extending longitudinally of the nip between the casting rolls to receive molten metal, the bottom wall of the trough being closed, and the outlets for molten metal in the longitudinal side walls comprising a series of horizontally spaced openings in each respective side wall.

According to the present invention there is also provided a method of starting-up casting with a twin roll caster, the caster comprising a pair of parallel casting rolls forming a nip between them, an elongate metal delivery nozzle disposed above and extending along the nip between the casting rolls for supplying molten metal into the nip, an entry nozzle for supplying molten metal to the metal delivery nozzle, and a tundish for supplying molten metal to the entry nozzle, the method comprising preheating to a temperature of at least 1000° C. the tundish, the metal delivery nozzle and the entry nozzle, positioning the preheated metal delivery nozzle relative to the casting rolls so that it is in its position disposed above and extending along the nip, fitting the preheated entry nozzle to the bottom of the preheated tundish, and lowering the tundish toward the delivery nozzle such that the entry nozzle extends into the delivery nozzle to enable the supply of molten metal from the tundish to the metal delivery nozzle via the entry nozzle.

The metal delivery nozzle may be positioned relative to the rolls before the entry nozzle is fitted to the tundish.

Alternatively, the entry nozzle may be fitted to the tundish before the delivery nozzle is positioned relative to the rolls and the tundish subsequently lowered to cause the entry nozzle to enter the delivery nozzle.

BRIEF DESCRIPTION OF THE DRAWINGS

In order that the invention may be more fully explained one particular apparatus and methods of operation of the apparatus will be described in some detail with reference to the accompanying drawings in which.

DETAILED DESCRIPTION OF THE PREFERRED EMBODIMENT

Figure 1:
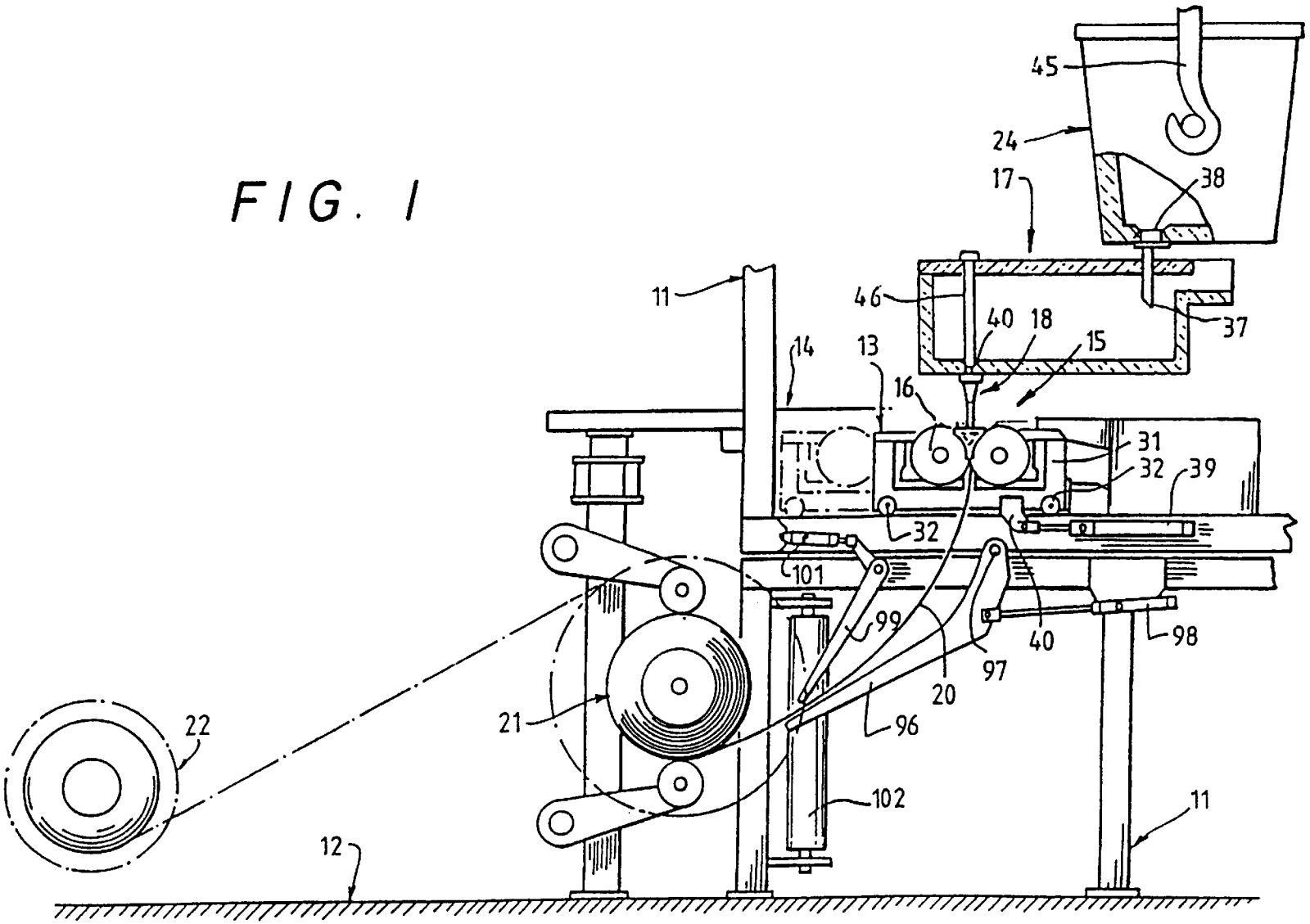
FIG. 1 illustrates a twin-roll continuous strip caster constructed and operating in accordance with the present invention.

The illustrated caster comprises a main machine frame 11 which stands up from the factory floor 12. Frame 11 supports a casting roll carriage 13 which is horizontally movable between an assembly station 14 and a casting station 15. Carriage 13 carries a pair of parallel casting rolls 16 to which molten metal is supplied during a casting operation from a ladle 24 via a tundish 17, an entry nozzle 18 and a delivery nozzle 19. Casting rolls 16 are water cooled so that shells solidify on the moving roll surfaces and are brought together at the nip between them to produce a solidified strip product 20 at the nip outlet. This product is fed to a standard coiler 21 and may subsequently be transferred to a second coiler 22.

Roll carriage 13 comprises a carriage frame 31 mounted by wheels 32 on rails 33 extending along part of the main machine frame 11 whereby roll carriage 13 as a whole is mounted for movement along the rails 33. Carriage frame 31 carries a pair of roll cradles in which the rolls 16 are rotatably mounted. Carriage 13 is movable along the rails 33 by actuation of a double acting hydraulic piston and cylinder unit 39, connected between a drive bracket 40 on the roll carriage and the main machine frame so as to be actuable to move the roll carriage between the assembly station 14 and casting station 15 and visa versa.

Casting rolls 16 are contra rotated through drive shafts 41 from an electric motor and transmission mounted on carriage frame 31. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. The rolls may typically be about 500 mm diameter and up to 2 m long in order to produce up to 2 m wide strip product.

Ladle 24 is of entirely conventional construction and is supported via a yoke 45 on an overhead crane whence it can be brought into position from a hot metal receiving station. The ladle is fitted with a slide gate valve 38 which is operable to allow molten metal to flow from the ladle into the tundish 17.

Tundish 17 is of conventional construction and has an outlet 40 in the floor to allow molten metal to flow from the tundish 17 to the entry nozzle 18. The tundish 17 is fitted with a stopper rod 46 to selectively open and close the outlet 40 and thereby control the flow of metal through the outlet.

Delivery nozzle 19 is formed as an elongate body made of a refractory material such as alumina graphite. Its lower part is tapered so as to converge inwardly and downwardly so that it can project into the casting pool. A mounting bracket 60 is provided to support the nozzle on the roll carriage frame and the upper part of the nozzle is formed with outwardly projecting side flanges 55 which locate on the mounting bracket.

Delivery nozzle 19 has an upwardly opening inlet trough 61 to receive molten metal flowing outwardly through the openings 92 of the entry nozzle. Trough 61 is formed between nozzle side walls 62 and end walls 70. The bottom of the trough is closed by a horizontal bottom floor 63. The bottom part of the longitudinal side walls 62 are downwardly convergent and are perforated by horizontally spaced openings 64 in the form of circular holes extending horizontally through the side walls. End walls 70 of the delivery nozzle are perforated by two large end holes 71.

Figure 2:
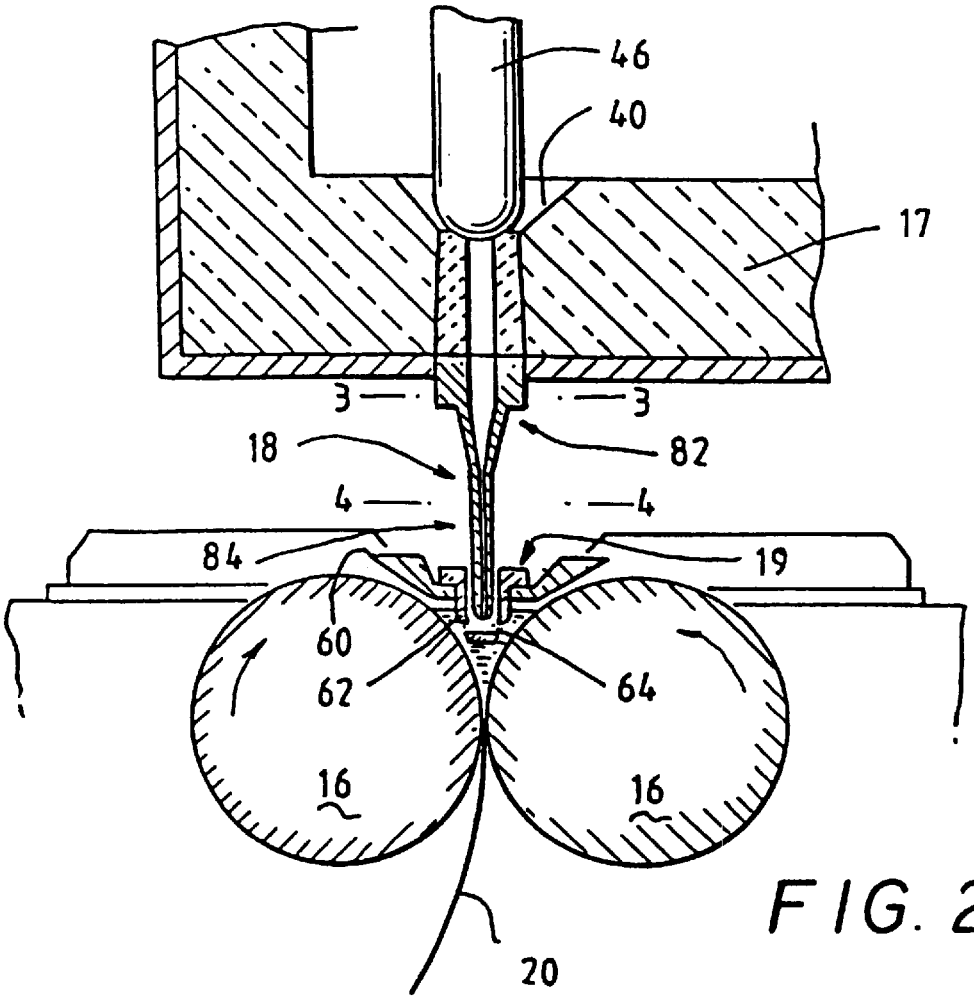
FIG. 2 is a vertical cross-section through important components of the caster illustrated in FIG. 1 including an entry nozzle constructed in accordance with the invention.
Figure 3:
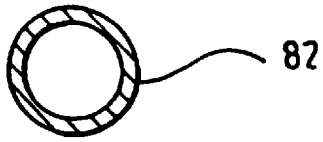
FIG. 3 is a transverse cross-section through an inlet end of the entry nozzle.
Figure 4:
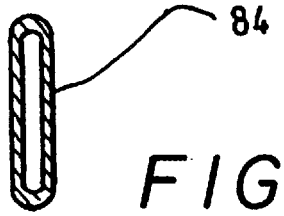
FIG. 4 is a transverse cross-section through an outlet end of the entry nozzle.
Figure 5:
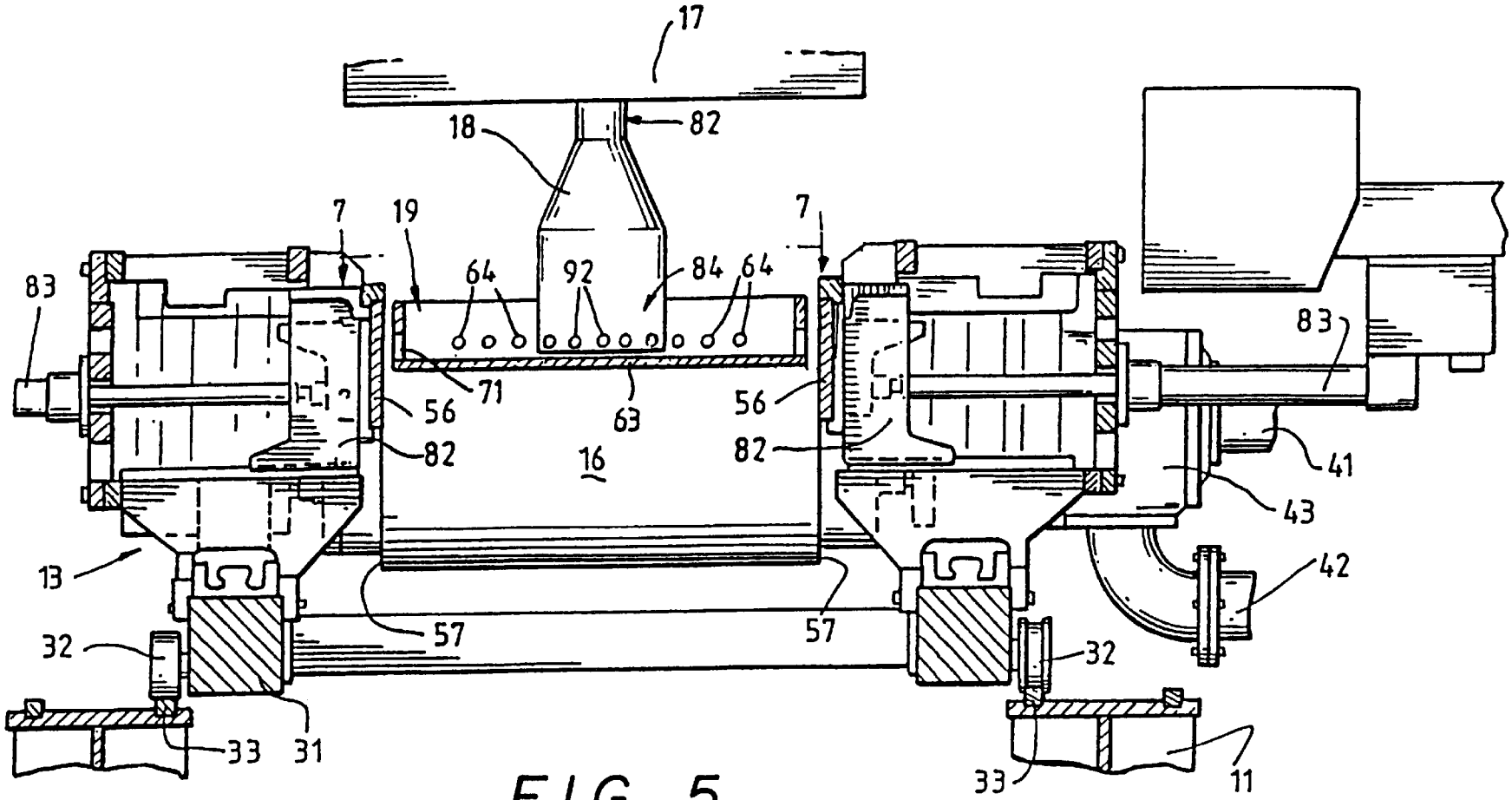
FIG. 5 is a further vertical cross-section through important components of the caster taken transverse to the section of FIG. 2.

Entry nozzle 18 is elongate and extends downwardly from an inlet end 82 that is connected to the tundish 17 to an outlet end 84 that extends into the delivery nozzle 19. As illustrated in FIG. 2, the cross-sectional shape of the passage defined by the entry nozzle changes progressively from a circular shape at the inlet end (FIG. 3) to a narrow elongate shape at the outlet end (FIG. 4). Specifically, the outlet end 84 is defined by a bottom wall 86, elongate side walls 88, narrow end walls 90, and a series of outlets 92 in the side walls 88. The outlet end 84 is positioned so that the side walls 88 are parallel to and spaced inwardly of the longitudinal side walls 62 of the delivery nozzle 19.

Molten metal flows from the entry nozzle 18 into a reservoir 66 of molten metal in the bottom part of the nozzle trough 61. Molten metal flows from this reservoir out through the side openings 64 and the end openings 71 to form a casting pool 68 supported above the nip 69 between the casting rolls 16. The casting pool is confined at the ends of rolls 16 by a pair of side closure plates 56 which are held against the ends 57 of the rolls. Side closure plates 56 are made of strong refractory material, for example boron nitride. They are mounted in plate holders 82 which are movable by actuation of a pair of hydraulic cylinder units 83 to bring the side plates into engagement with the ends of the casting rolls to form end closures for the casting pool of molten metal.

In the casting operation the flow of metal is controlled to maintain the casting pool at a level such that the lower end of the delivery nozzle 19 is submerged in the casting pool and the two series of horizontally spaced side openings 64 of the delivery nozzle are disposed immediately beneath the surface of the casting pool. The molten metal flows through the openings 64 in two laterally outwardly directed-jet streams in the general vicinity of the casting pool surface so as to impinge on the cooling surfaces of the rolls in the immediate vicinity of the pool surface.

Figure 6:
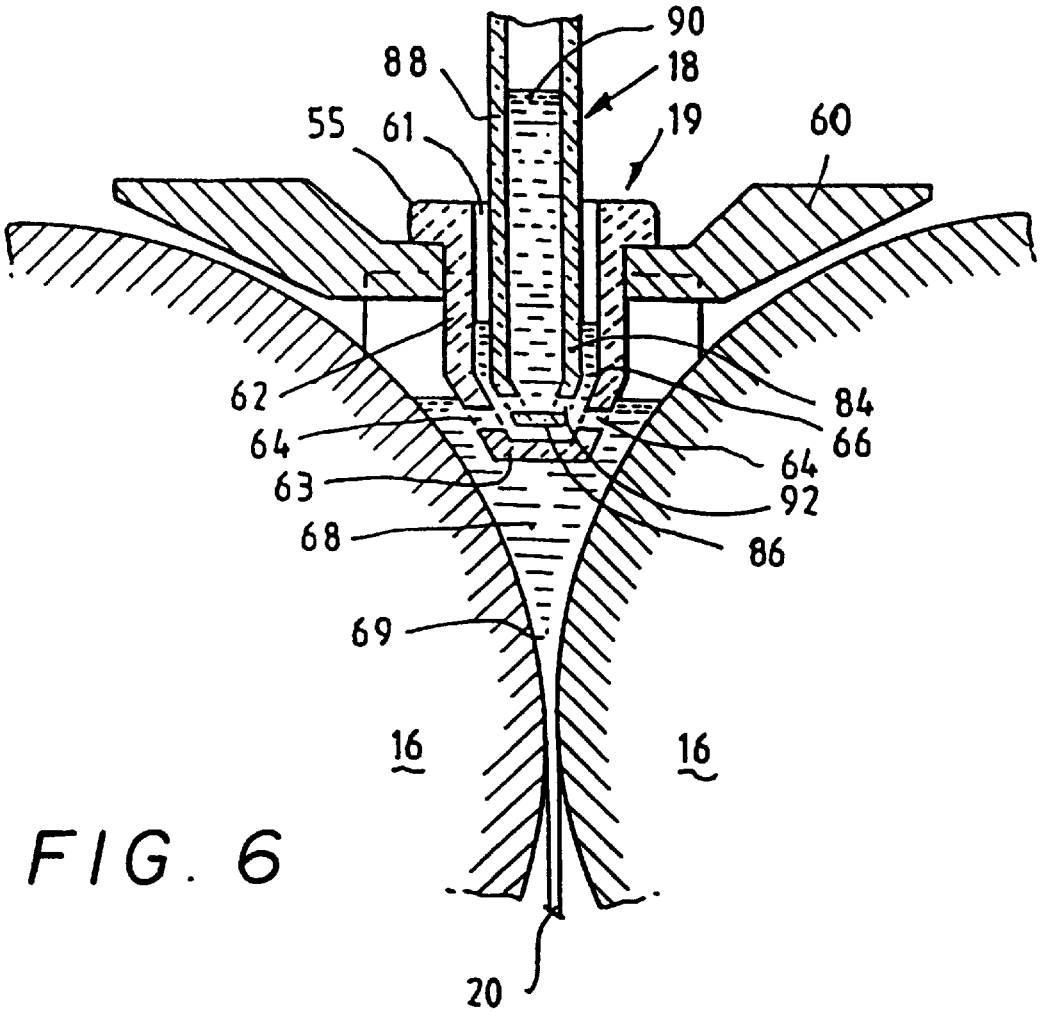
FIG. 6 is an enlarged transverse cross-section through the entry nozzle and adjacent parts of the casting rolls.
Figure 7:
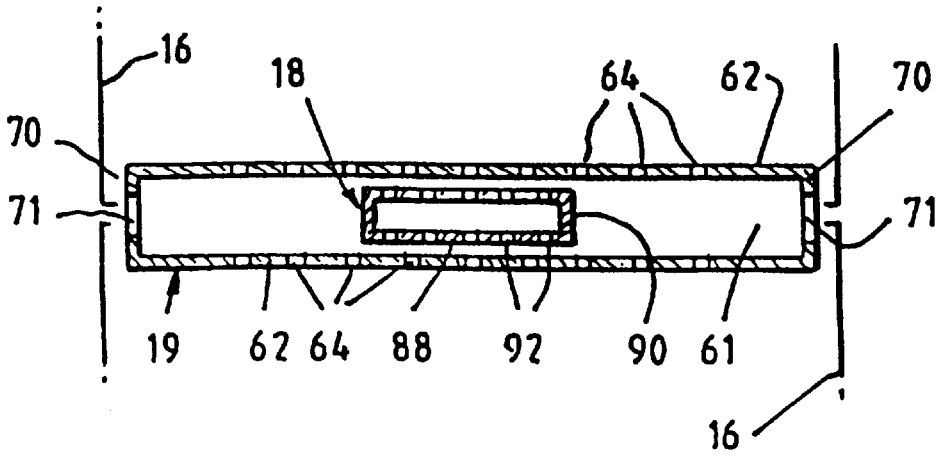
FIG. 7 is a partial plan view on the line 7—7 in FIG. 5.

The purpose of the entry nozzle 18 is to control the flow of molten metal from the tundish 17 into the delivery nozzle 19 so that the delivery nozzle 19 can deliver a required flow of molten metal into the casting pool 68 and to do this in a manner which produces minimum turbulence and splashing within the delivery nozzle and a controlled reduction of kinetic energy of the molten metal flowing downwardly from the tundish. The effective cross sectional area of the entry nozzle is much smaller than the inlet trough 61 of delivery nozzle 19 with the result that a substantial head of molten metal builds up within the entry nozzle so as substantially to fill the bottom rectangular cross-section part of that nozzle to a height well above the delivery nozzle 19 as indicated by the column of molten metal 90 shown in FIG. 6. The result is that the molten metal falling from the tundish initially flows through the circular cross section upper part of the entry nozzle but the flow is then shaped so as to widen and fall into the column of molten metal 90 filling the rectangular bottom end of the entry nozzle. The kinetic energy of the molten metal is thus reduced within the entry nozzle and the metal can flow smoothly downwardly into the trough 61 through the entry nozzle outlets 92. The outlets 92 are preferably staggered in the longitudinal direction relative to the side outlets 64 of the delivery nozzle so that the metal cannot jet outwardly directly through the adjacent delivery nozzle outlet 64 but is initially confined within the pool so as to further reduce the kinetic energy and contribute to a smooth even flow from the nozzle side openings 64 throughout the length of the delivery nozzle 19.

Prior to a casting operation the refractory materials of tundish 17, delivery nozzle 19 and the side closure plates 56, as well as the entry nozzle 18, must all be preheated to a temperature of at least 1000° C. It is not feasible to preheat all of these components in situ and it is therefore preferred that they all be preheated at preheat stations and then brought together in sequence into a final assembly prior to casting. The delivery nozzle 19, the entry nozzle 18 and the side closure plates 56 may be preheated in individual preheat gas or electric furnaces whereas the much larger tundish 17 may be preheated by preheat torches. After preheating the refractory components can be moved from the preheat stations by appropriate robot devices into a final assembly in the manner to be described below. The detailed design of appropriate robotics for the movement of the tundish delivery nozzle and side closure plates is illustrated and described in detail in the applicants' Australian Patent No 631728 and corresponding U.S. Pat. Nos. 5,184,668 and 5,277,243. A similar robotic device can be used for movement of the entry nozzle 18 in the correct sequence as described below.

Figure 8:
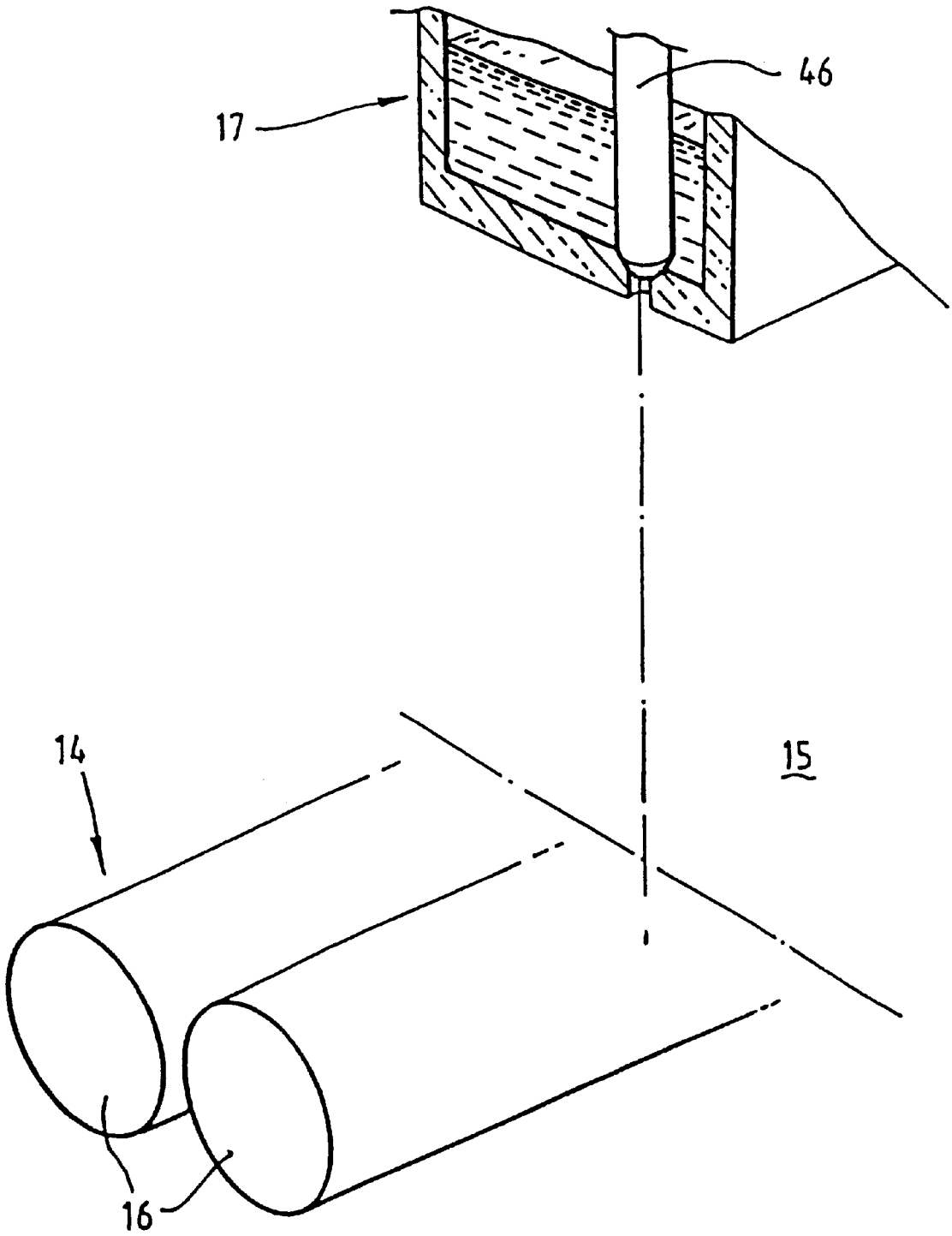
FIGS. 8 to 12 illustrate the manner in which various components of the apparatus may be brought together in sequence at start-up of a casting operation.

FIGS. 8 to 12 illustrate a sequence by which the various components of the apparatus are brought together at start-up of a casting operation. In the first step of the sequence as illustrated in FIG. 8, the preheated tundish is brought into a position at the casting station 15 and is filled with molten metal from the ladle while the stopper rod 46 is in its closed position to prevent discharge of metal from the tundish. During this tundish filling step, the tundish is held in a raised position considerably above its final position for casting. At this stage the rolls 16 are held at the assembly station 14.

Figure 9:
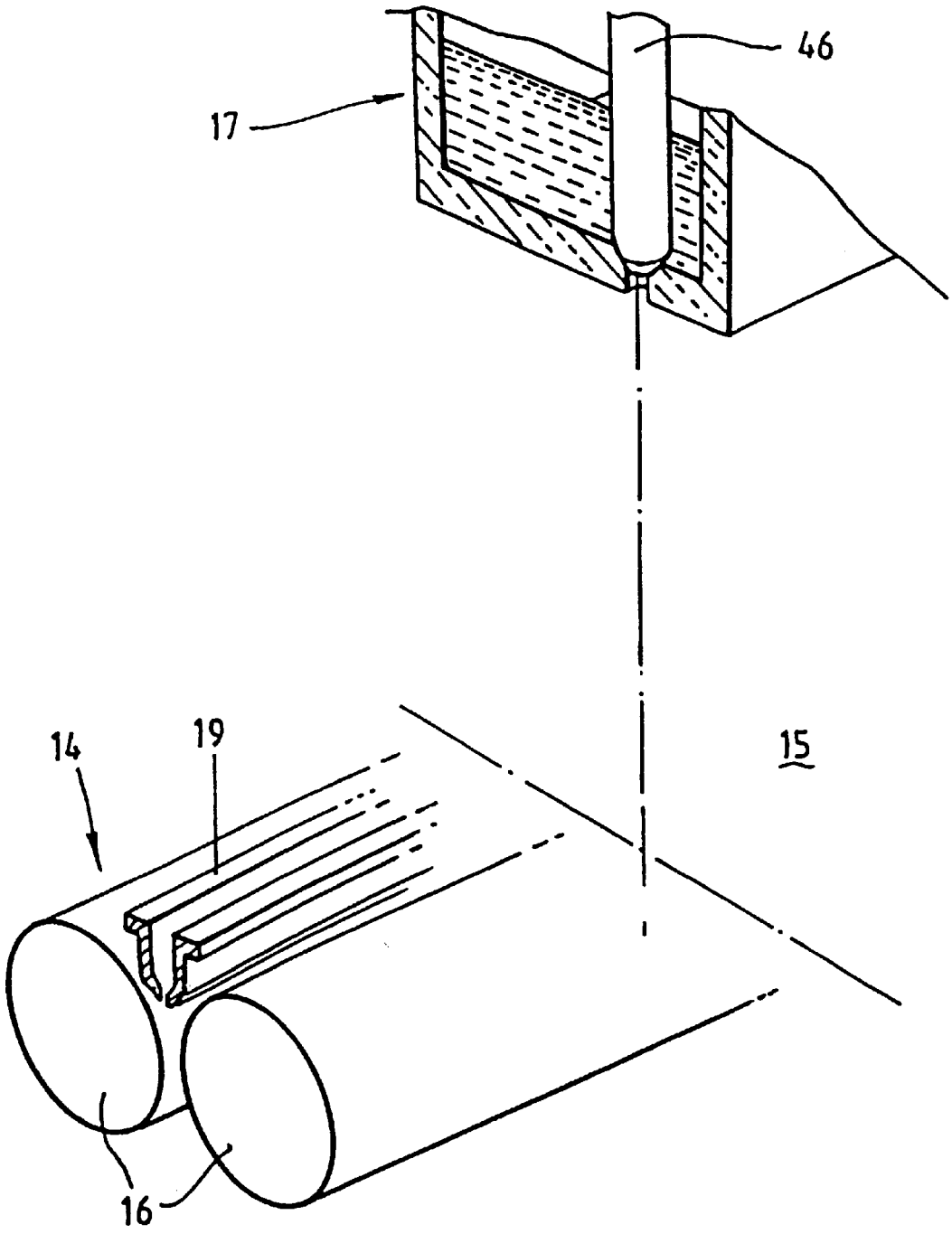

In the next step in the sequence as illustrated in FIG. 9, the preheated metal delivery nozzle 19 is brought into position relative to the casting rolls at the assembly station so that it is in its position disposed immediately above the nip and extending along the nip between the rolls.

Figure 10:
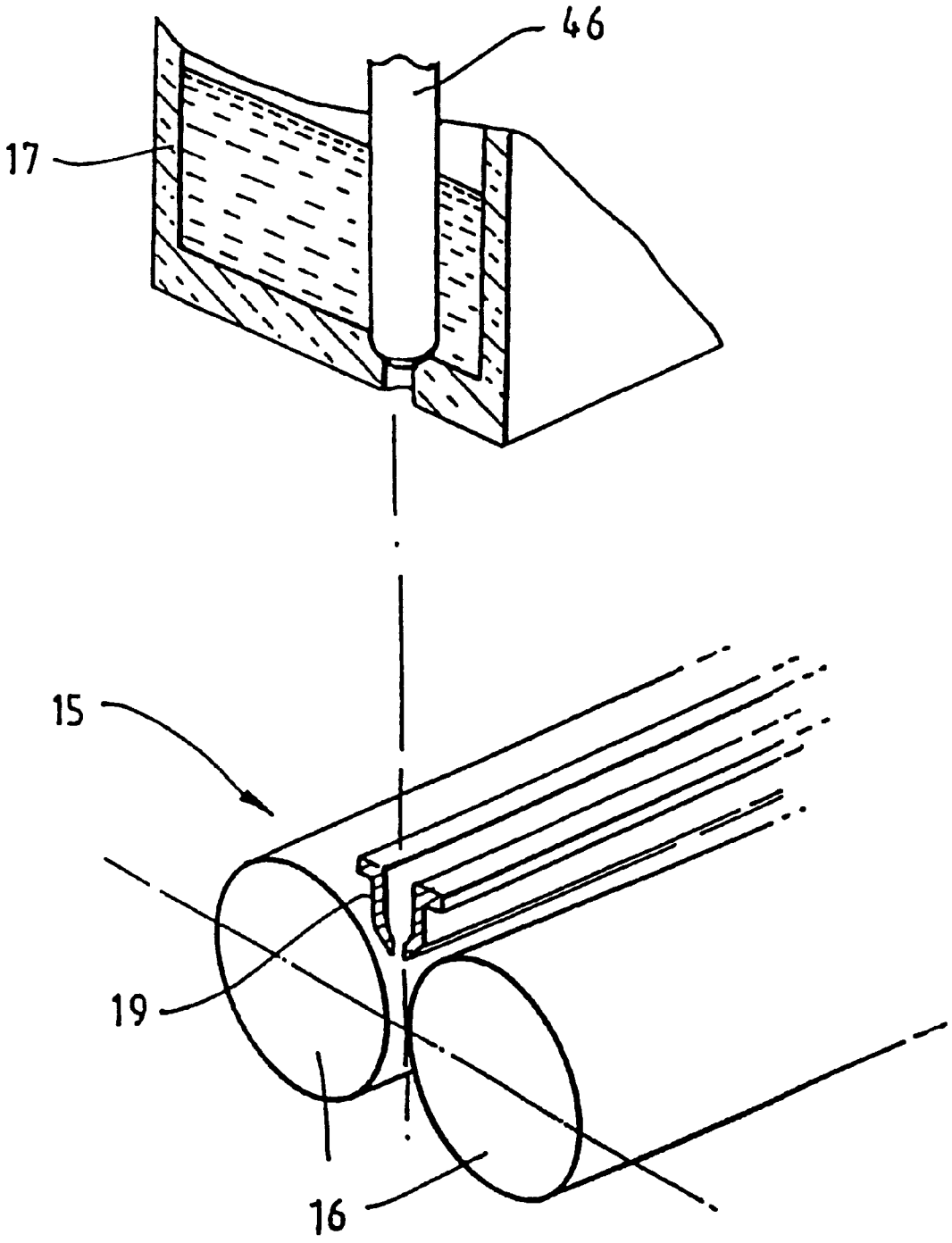

The third step in the sequence as illustrated in FIG. 10 is to move the casting rolls together with the correctly positioned preheated delivery nozzle 19 to the casting station 15 by actuation of the piston and cylinder unit 39 to move the roll carriage 13 along the rolls 33.

Figure 11:
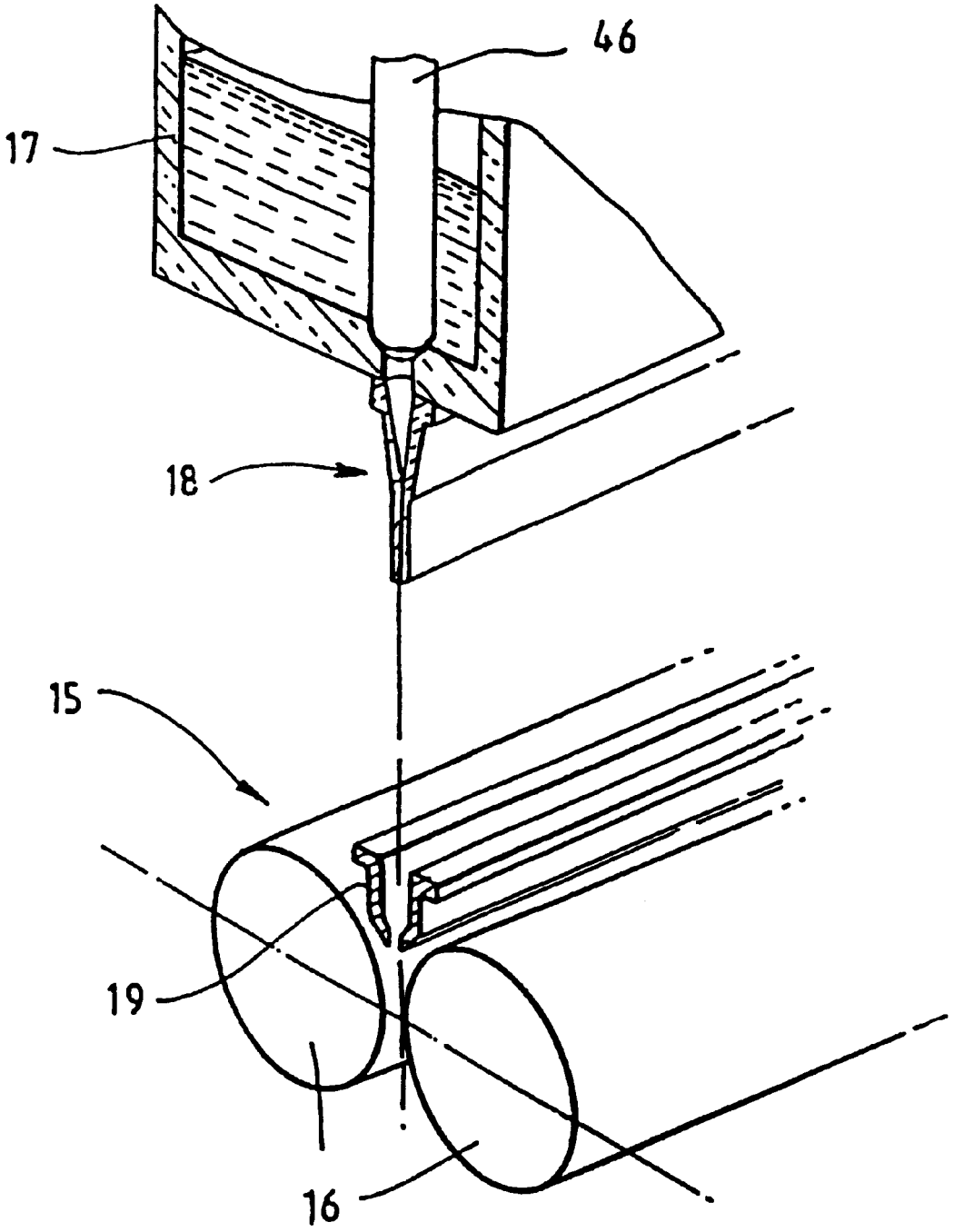
Figure 12:
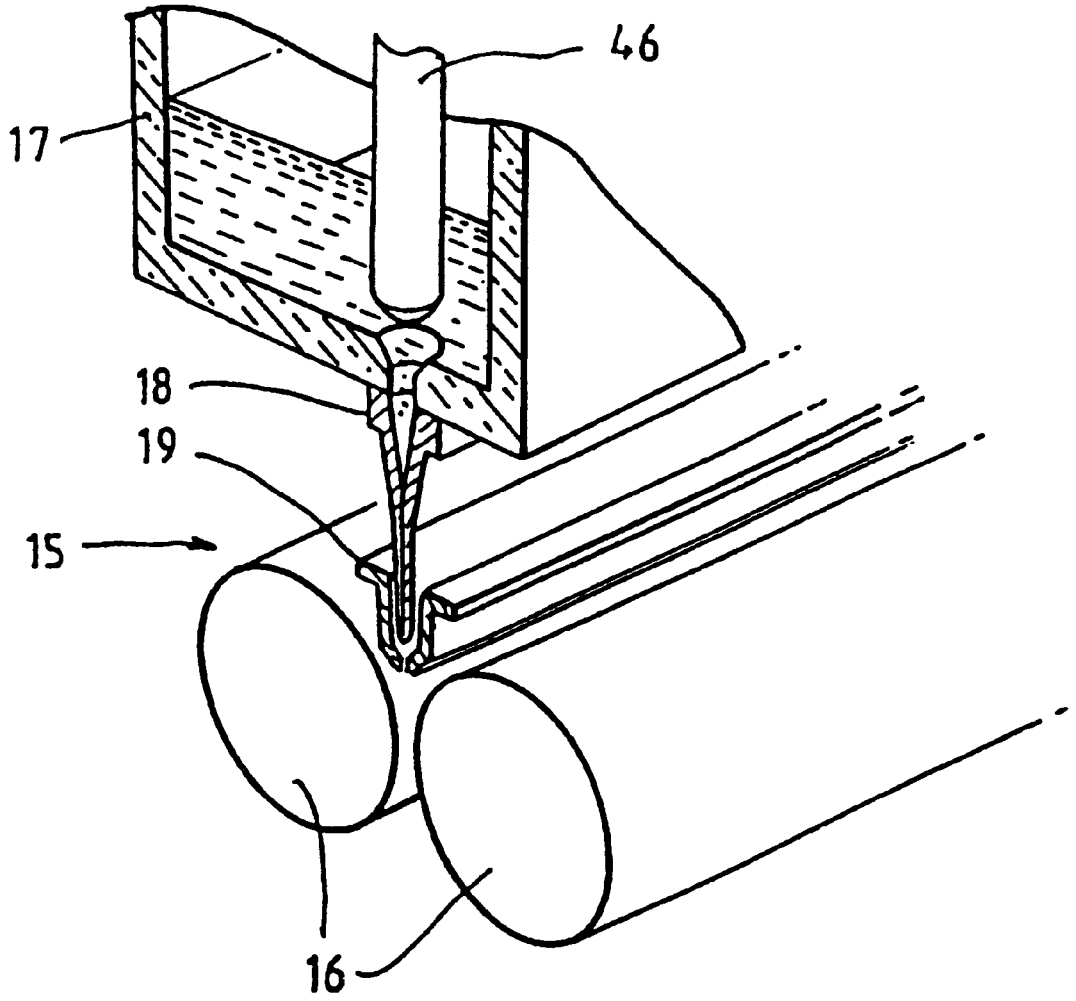

In a fourth step in the sequence as illustrated in FIG. 11, the preheated entry nozzle 18 is fitted to the bottom of tundish 17. In a final step as illustrated in FIG. 12 the tundish 17 is lowered at the casting station together with the preheated entry nozzle 18 so that the entry nozzle enters the upwardly opening trough of the delivery nozzle 19 and the stopper rod 46 is withdrawn to release molten metal from the tundish whence it flows through entry nozzle 18 to the delivery nozzle 19 to initiate a casting operation.

It is not essential that the roll 16 be moveable from an assembly station to the casting station and then may simply remain at the casting station. In that case the tundish may be brought into its filling position at the casting station and the delivery nozzle 19 then fitted between the rolls to bring the apparatus into the same condition as illustrated in FIG. 10. It would be possible to vary the sequence of assembly so that the delivery nozzle is brought into position before the tundish. However it takes a significant time to fill the tundish and in order to avoid unnecessary cooling of the smaller refractory components and also the need to avoid unnecessary transport of a filled tundish it is preferred to fill the tundish at the casting station before the smaller refractory components are brought into position. In all start up sequences, however, the entry nozzle is fitted to the bottom of the tundish and the tundish is subsequently lowered toward the delivery nozzle after the delivery nozzle has been positioned relative to the casting rolls so as to cause the entry nozzle to extend into the delivery nozzle to enable the supply of molten metal from the tundish to the delivery nozzle via the entry nozzle.

What is claimed is:

1. A method of starting-up casting with a twin roll caster, the caster comprising a pair of parallel casting rolls forming a nip between them, an elongate metal delivery nozzle disposed above and extending along the nip between the casting rolls for supplying molten metal into the nip to form a casting pool and comprising an elongate trough with side openings for delivery of molten metal into the casting pool, an entry nozzle for supplying molten metal to the metal delivery nozzle, and a tundish for supplying molten metal to the entry nozzle, the method comprising preheating to a temperature of at least 1000° C. the tundish, the metal delivery nozzle and the entry nozzle, positioning the preheated metal delivery nozzle relative to the casting rolls so that it is in its position disposed above and extending along the nip, fitting the preheated entry nozzle to the bottom of the preheated tundish, and lowering the tundish toward the delivery nozzle such that the entry nozzle extends in to the delivery nozzle to enable the supply of molten metal from the tundish to the metal delivery nozzle via the entry nozzle.

2. A method as claimed in claim 1, wherein the metal delivery nozzle is positioned relative to the rolls before the entry nozzle is fitted to the tundish.

3. A method as claimed in claim 1, wherein the delivery nozzle is positioned relative to the casting rolls while the casting rolls are at an assembly station and the assembled rolls and delivery nozzle are then moved to a casting station at which the tundish and entry nozzle are lowered to cause the entry nozzle to enter the delivery nozzle.

4. A method as claimed in claim 1, wherein the tundish, the metal delivery nozzle and the entry nozzle are preheated at respective preheat stations remote from their casting positions and are brought to their casting positions after preheating.

5. A method as claimed in claim 2, wherein the delivery nozzle is positioned relative to the casting rolls while the casting rolls are at an assembly station and the assembled rolls and delivery nozzle are then moved to a casting station at which the tundish and entry nozzle are lowered to cause the entry nozzle to enter the delivery nozzle.

6. A method as claimed in claim 2, wherein the preheated tundish is brought to a position directly above is casting position and is charged with molten metal before the preheated delivery nozzle is positioned relative to the rolls or the entry nozzle is fitted to the tundish.

7. A method as claimed in claim 3, wherein the preheated tundish is brought to a position directly above its casting position and is charged with molten metal before the preheated delivery nozzle is positioned relative to the rolls or the entry nozzle is fitted to the tundish.

8. A method as claimed in claim 5, wherein the preheated tundish is brought to a position directly above its casting position and is charged with molten metal before the preheated delivery nozzle is positioned relative to the rolls or the entry nozzle is fitted to the tundish.

9. A method as claimed in claim 2, wherein the tundish, the metal deliver nozzle and the entry nozzle are preheated at respective preheat stations remote from their casting positions and are brought to their casting positions after preheating.

10. A method as claimed in claim 3, wherein the tundish, the metal deliver nozzle and the entry nozzle are preheated at respective preheat stations remote from their casting positions and are brought to their casting positions after preheating.

11. A method as claimed in claim 3, wherein the tundish, the metal delivery nozzle and the entry nozzle are preheated at respective preheat stations remote from their casting positions and are brought to their casting positions after preheating.

12. A method as claimed in claim 5, wherein the tundish, the metal deliver nozzle and the entry nozzle are preheated at respective preheat stations remote from their casting positions and are brought to their casting positions after preheating.

13. A method as claimed in claim 6, wherein the tundish, the metal deliver nozzle and the entry nozzle are preheated at respective preheat stations remote from their casting positions and are brought to their casting positions after preheating.

14. A method as claimed in claim 7, wherein the tundish, the metal deliver nozzle and the entry nozzle are preheated at respective preheat stations remote from their casting positions and are brought to their casting positions after preheating.

15. A method as claimed in claim 8, wherein the tundish, the metal deliver nozzle and the entry nozzle are preheated at respective preheat stations remote from their casting positions and are brought to their casting positions after preheating.

16. A method of starting-up casting with a twin roll caster, the caster comprising a pair of parallel casting rolls forming a nip between them, an elongate metal delivery nozzle disposed above and extending along the nip between the casting rolls for supplying molten metal into the nip to form a casting pool and comprising an elongate trough with side openings for delivery of molten metal into the casting pool, an entry nozzle for supplying molten metal to the metal delivery nozzle, and a tundish for supplying molten metal to the entry nozzle, the method comprising preheating to a temperature of at least 1000° C. the tundish, the metal delivery nozzle and the entry nozzle, bringing the preheated tundish to a position directly above its casting position, charging the tundish with molten metal and subsequently positioning the preheated metal delivery nozzle relative to the casting rolls so that it is in its position disposed above and extending along the nip, fitting the preheated entry nozzle to the bottom of the preheated tundish, and lowering the tundish toward the delivery nozzle such that the entry nozzle extends into the delivery nozzle to enable the supply of molten metal from the tundish to the metal delivery nozzle via the entry nozzle.

17. A method as claimed in claim 16, wherein the delivery nozzle is positioned relative to the casting rolls by placing the delivery nozzle into an assembly with the casting rolls while the casting rolls are at an assembly station and then moving the assembled rolls and delivery nozzle to a casting station beneath the tundish charged with molten metal prior to fitting the preheated entry nozzle to the tundish.

* * * * *

UNITED STATES PATENT AND TRADEMARK OFFICE

CERTIFICATE OF CORRECTION

PATENT NO. : 6,453,986 B1 
DATED : September 24, 2002
INVENTOR(S) : Stephen Bruce Leabeater et al.

It is certified that error appears in the above-identified patent and that said Letters Patent is hereby corrected as shown below:

Column 7,
Line 67, the phrase "above is casting position", should be corrected to read
-- above its casting position --.

Signed and Sealed this

Tenth Day of June, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,453,986 B1 
DATED : September 24, 2002
INVENTOR(S) : Stephen Bruce Leabeater et al.

It is certified that error appears in the above-identified patent and that said Letters Patent is hereby corrected as shown below:

Column 8,
Line 24, "claim 3" should be corrected to read -- claim 16 --.

Signed and Sealed this

First Day of November, 2005

JON W. DUDAS
*Director of the United States Patent and Trademark Office*